US006675812B1

(12) United States Patent
Wiley

(10) Patent No.: US 6,675,812 B1
(45) Date of Patent: Jan. 13, 2004

(54) DISPENSER WITH COMB OR BRUSH WITH OPTIONAL SPONGE FOR CREAM, LOTION, GEL OR LIQUID

(76) Inventor: Lien L. Wiley, 2164 Brownstone Creek Ave., Simi Valley, CA (US) 93063

( * ) Notice: Subject to any disclaimer, the term of this patent is extended or adjusted under 35 U.S.C. 154(b) by 0 days.

(21) Appl. No.: 10/287,314

(22) Filed: Nov. 5, 2002

Related U.S. Application Data

(60) Provisional application No. 60/380,166, filed on May 7, 2002.

(51) Int. Cl.[7] ..... A45D 24/16; A45D 24/22

(52) U.S. Cl. ..... 132/108; 132/116; 132/139

(58) Field of Search ..... 222/192; 132/112, 132/108–110, 116; 401/270, 271, 282, 284, 263, 265

(56) References Cited

U.S. PATENT DOCUMENTS 2,228,213 A * 1/1941 Hillsberry ..... 132/212
2,617,431 A * 11/1952 Gaspari ..... 132/120
2,922,425 A * 1/1960 Lerner et al. ..... 132/212
4,209,027 A * 6/1980 Morganroth ..... 132/212
5,547,303 A * 8/1996 Pyrozyk ..... 401/270
5,908,256 A * 6/1999 Bernstein ..... 401/205
6,000,405 A * 12/1999 De Laforcade ..... 132/116
6,315,478 B1 * 11/2001 Atkins ..... 401/37

* cited by examiner

*Primary Examiner*—Kevin Shaver
*Assistant Examiner*—Stephanie Willatt
(74) *Attorney, Agent, or Firm*—Allen A Dicke, Jr.

(57) ABSTRACT

The dispenser has its internal fluid space fed from a reservoir. The face of the dispenser has dispensing openings and, around the dispensing openings are fingers, bristles or sponge which aid in distributing the dispensed fluid. The dispenser is particularly useful in the application of health and beauty fluid s to the hair because the fingers, bristles or sponge can distribute the fluid in the hair or on other surfaces. The dispenser head preferably also has comb teeth or brush thereon so that, as part of the process, the hair can be combed or brushed.

16 Claims, 4 Drawing Sheets

DISPENSER WITH COMB OR BRUSH WITH OPTIONAL SPONGE FOR CREAM, LOTION, GEL OR LIQUID

CROSS-REFERENCE

This application relies for priority upon Provisional Application Serial No. 60/380,166, filed May 7, 2002, entitled"Dispensers with Applicator Fingers, Brush, Comb, Sponge or Rubber Insert for Liquid, Gel, Cream or Lotion,"

FIELD OF THE INVENTION

This invention is directed to a dispenser by which cream, lotion, gel or liquid can be applied, distributed, combed and spread in for application to the person, to a surface, and particularly to the hair.

BACKGROUND OF THE INVENTION

For various applications of health and beauty products to the person, or other types of product to other surfaces, it is often necessary to dispense creams, lotions, gels or liquids to particular parts of the body or other surfaces. The application of health and beauty materials of various consistencies is difficult to achieve properly. Often, the materials are applied to the hand and then to the area in which the health and beauty product is desired to be placed. However, the concave shape of the palm of the hand prevents the even deposition of the health and beauty product or other types of product to the selected area. Unless great care is taken, when the material is applied to the palm of the hand, the spreading is uneven. It is also to be noted that it is usually not intended that this material be applied to the hand. The hand is merely a method of conveying the fluid material to the area to which it is to be applied. There is loss of material because that which remains in the palm of the hand is washed away.

There is an additional problem when the health and beauty material in cream, lotion, gel or liquid form is intended for the hair. Such materials are often dyes or bleaches, which should not be applied to other areas. Thus, the present method of applying the fluid material by application from the hand is undesirable. It is helpful to have comb or brush fingers to disperse the health and beauty fluid into the hair.

SUMMARY OF THE INVENTION

In order to aid in the understanding of this invention, it can be stated in essentially summary form that it is directed to a dispenser with fingers and/or combs, and/or brush, and/or sponge. The dispenser includes a reservoir connected so that the applicator distributes a health, beauty or other type of fluid to the fingers and/or comb, and/or brush, and/or sponge so that they can quickly and evenly distribute the fluid.

It is, thus, a purpose and advantage of this invention to provide an improved dispenser with fingers and/or comb, and/or brush, and/or sponge for health and beauty fluids and other types of product so that the fluids can be dispensed to the proper location and worked therein by the action of fingers, and/or comb, and/or brush, and/or sponge.

It is a further purpose and advantage of this invention to provide an improved dispenser with fingers and/or comb, brush and/or sponge, for health and beauty fluids and other types of product so that the fluids can be dispensed to the proper location and worked therein by the action of fingers or comb, or brush, or sponge.

It is a further purpose and advantage of this invention to provide a dispenser which is of economic construction so that it can be widely used for dispensing various health and beauty fluids and other products and for working them into the areas where they are dispensed.

It is another purpose and advantage of this invention to provide a dispenser which includes a reservoir for health and beauty products and other products of fluid consistency together with a dispensing head which includes finger and/or comb, brush or sponge for aiding the distribution of the fluid product.

It is another purpose and advantage of this invention to provide a reservoir with a dispenser mounted thereon, with the mounting being such that the reservoir can be conveniently held in the hand and the dispenser can reach to the desired dispensing location.

These and other purposes and advantages of this invention will become apparent from a study of the following portion of the specification taken in conjunction with the accompanying drawings.

DESCRIPTION OF THE PREFERRED EMBODIMENTS

Figure 1:
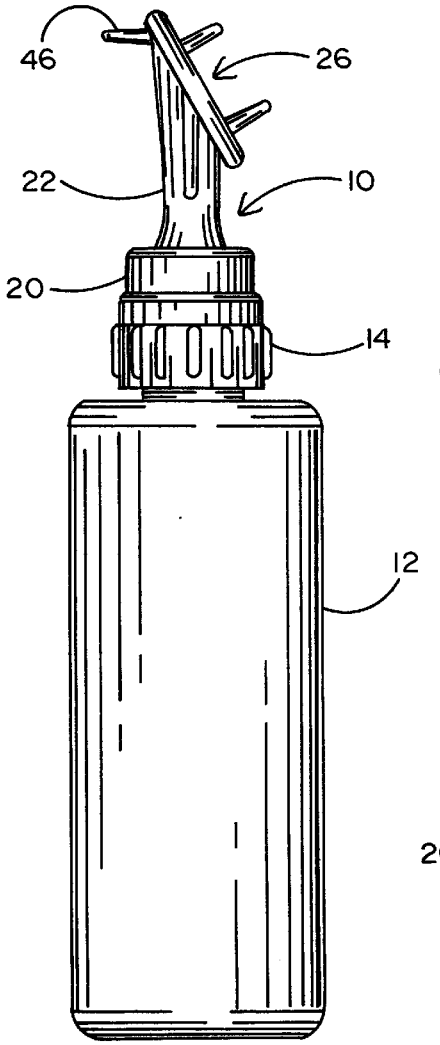
FIG. 1 is a side-elevational view of a first preferred embodiment of the dispenser of this invention, WITH COMB OR BRUSH AND FINGERS WITH OPTIONAL SPONGE for cream, lotion, gel or liquid dispensing.

FIG. 1 shows the first preferred embodiment of the dispenser with fingers and comb, in accordance with this invention wherein it is generally indicated at 10. The dispenser preferably includes a reservoir 12, which is preferably a squeeze bottle but may be a pressurized bottle or reservoir in a handle. The dispenser has a cap 14 which is attached to the reservoir 12, such as by the screw threads illustrated in FIG. 2. It may snap onto the reservoir. A cap carries a valve plug 16 which is mounted on a plurality of webs 18. The webs permit the fluid material to pass upward from the reservoir past the webs and past the valve plug 16. Valve body 20 is mounted to slide up and down on the cap and has a cap (not shown) which limits the upward movement of the valve body 20 on the cap 14 to the maximum position shown in FIG. 2.

The valve body carries a feed tube 22. At the base of the feed tube is a valve opening 24 which permits upward flow of the health and beauty fluid when the valve is in the open position shown in FIG. 2. When the valve body 20 is passed downward into cap 14, the feed tube also moves downward and the fluid opening 24 is plugged by valve plug 16. This cuts off flow.

Figure 3:
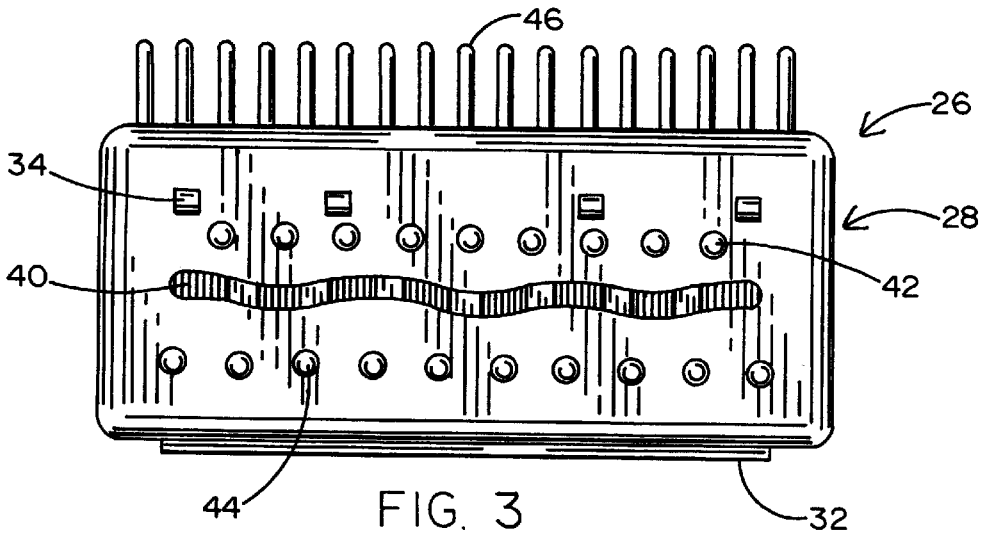
FIG. 3 is an angular view of the dispensing surface showing the dispensing opening, fingers and comb.
Figure 4:
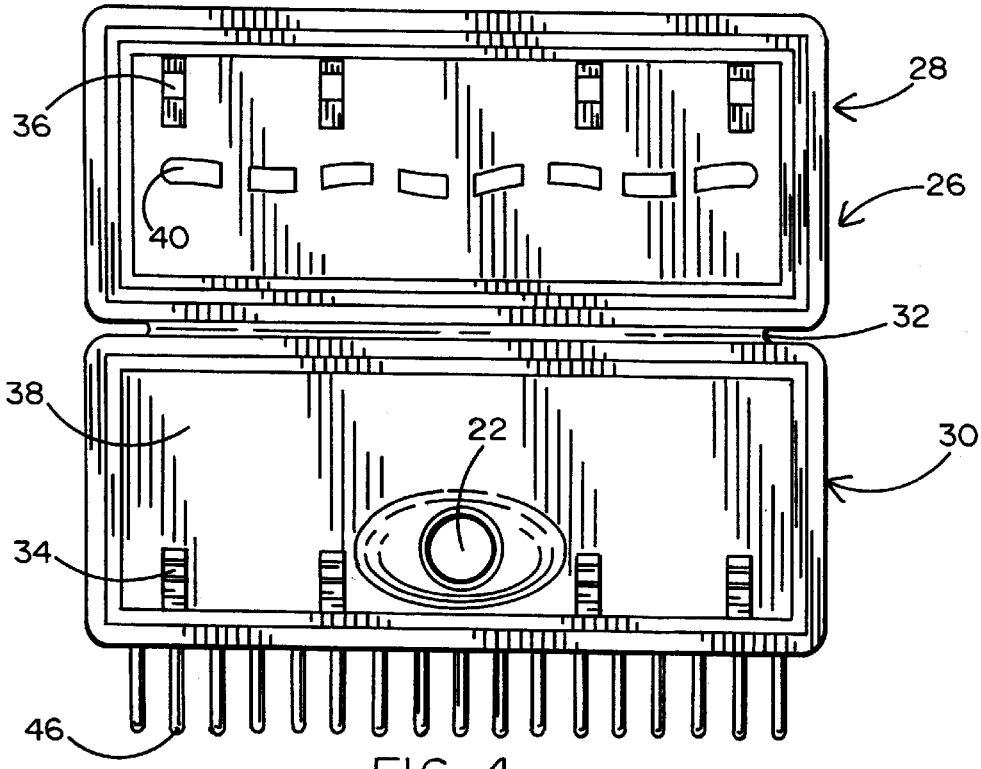
FIG. 4 is a view of the inside of the dispenser head folded open.

The upper end of feed tube 22 carries dispenser head 26. The dispenser head, shown in more detail in FIGS. 3 and 4, is formed of front panel 28 and back panel 30, which are joined by a self hinge 32. The dispenser head 26 is preferably injection molding of a synthetic polymer composition material which is capable of this type of flexure. There is a plurality of lock pins 34 which engage lock notches 36 to hold the front and back panels together once they are closed, see FIG. 2. The front and back panels are configured so that their edges seal together. They may be adhesively attached or self-welded to make the closure permanent. The front and back panels each has a recess therein between the edges so that, when they are closed, they form a pocket 38. The pocket 38 is connected to receive fluid material from feed tube 22, see FIG. 2.

The front of the front panel has a sinuous slot 40 therein, which is interrupted with enough cross bands to maintain structural integrity. Thus, when the reservoir 12 is squeezed and the valve 20 is opened, fluid health and beauty products, or other types of similar products, is expelled upward through feed tube 22 into pocket 38 and out through the sinuous slot 40. Flow is controlled by squeezing and is cut off by closing the valve opening 24.

A plurality of fingers are positioned in at least one row. Two rows 42 and 44, one on each side of the sinuous slot 40. The fingers are thick bristles. As the fluid health and beauty or other product is expelled out of the sinuous slot 40, manual motion of the dispenser 10 causes the fingers 42 and 44 to distribute the fluid being expelled. This is particularly useful when the fluid is a hair product, such as shampoo, conditioner or other types of products. It is also useful in the application of bleaches and dyes to the hair. As the fluid is dispensed, the fingers work the fluid through the hair for even distribution. Such stirring action of the fingers in the hair may cause the hair to become tangled. Thus some distributing motion by the fingers followed immediately by combing is very helpful to quickly treat the hair. To aid in its combing, comb teeth 46 are formed in the row at the top back of the dispenser head, see FIGS. 1 and 2. With this construction, the material can be worked into the hair and the hair can be combed immediately by turning the dispenser 10 around so that the comb is in operative position.

The face of the dispensing head is preferably at a convenient angle, such as the 30 degree angle with respect to the axis of the bottle and the feed tube. However, this angle may be anything between 0 degree and 90 degrees depending upon the fluid material dispensed and the part of the body or other surface onto which it is to be dispensed.

Figure 5:
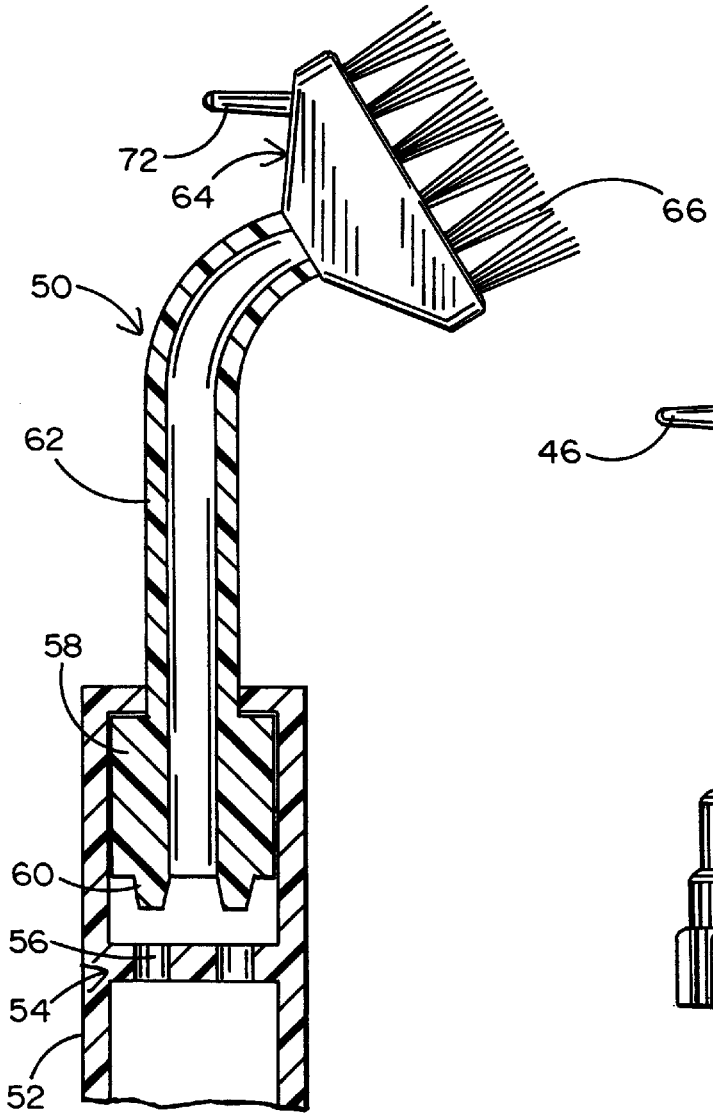
FIG. 5 is a side-elevational view, with parts broken away and parts taken in section of a second preferred embodiment of the dispenser with fingers and brush for cream, lotion, gel or liquid in accordance with this invention.

Another preferred embodiment of the dispenser of this invention is generally indicated at 50 in FIG. 5. The dispenser 50 has a reservoir 52 which is preferably pressurized either by self-pressurization or by introduction of a pressurized gas. The reservoir 52 is mounted into valve 54, which has through passage 56, which is open in the position shown in FIG. 5. Collar 58 slides in the body of valve 54 and has plugs 60, which engage in the passages 56 to close them when the collar is slide down in the body of valve 54 to close the valve. Feed tube 62 receives the health and beauty fluid or other types of product and delivers it to dispenser head 64. The dispenser head 64 is similar to dispenser head 26. It has a group of brush bristles 66 which are on the sides of the sinuous slot 70. In addition, the upper back of the dispenser head 64 is fitted with comb teeth 72. The feed tube 62 can be any length or shape desired, while the reservoir 52 can be of any convenient size or location. In FIG. 5, the feed tube is shown as presenting the face of the dispenser head 64 at about a 120 degree angle with respect to the axis of the reservoir. The angle can be anywhere from 0 to 180 degrees, depending upon the material to be applied and the location to which it will be applied. The angle is chosen to be comfortable and convenient to the user, so that she can apply the fluid health and beauty product or other types of product to the desired surface. The feed tube may be flexible if moving of the reservoir is inconvenient.

Figure 6:
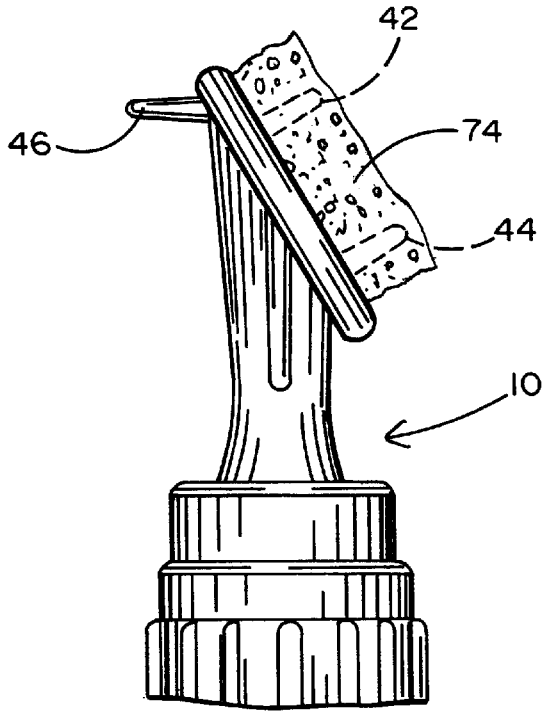
FIG. 6 is a side-elevational view of another embodiment of the dispenser head.

FIG. 6 is an illustration of the dispenser head 10, which has an open cell synthetic polymer foam pad 74 thereon. The foam pad has pockets therein so that the fingers 42 and 44 extend into the pockets. The fingers in the finger pockets hold the pad 74 in place. The pad 74 is sufficiently porous that the fluid health and beauty product, or other types of product, is emitted from the sinuous slot 40. It can move through the pad 74 and can be deposited. In the preferred embodiment, the pad is thicker than the fingers are long so that the fingers hold the pad in place.

Figure 2:
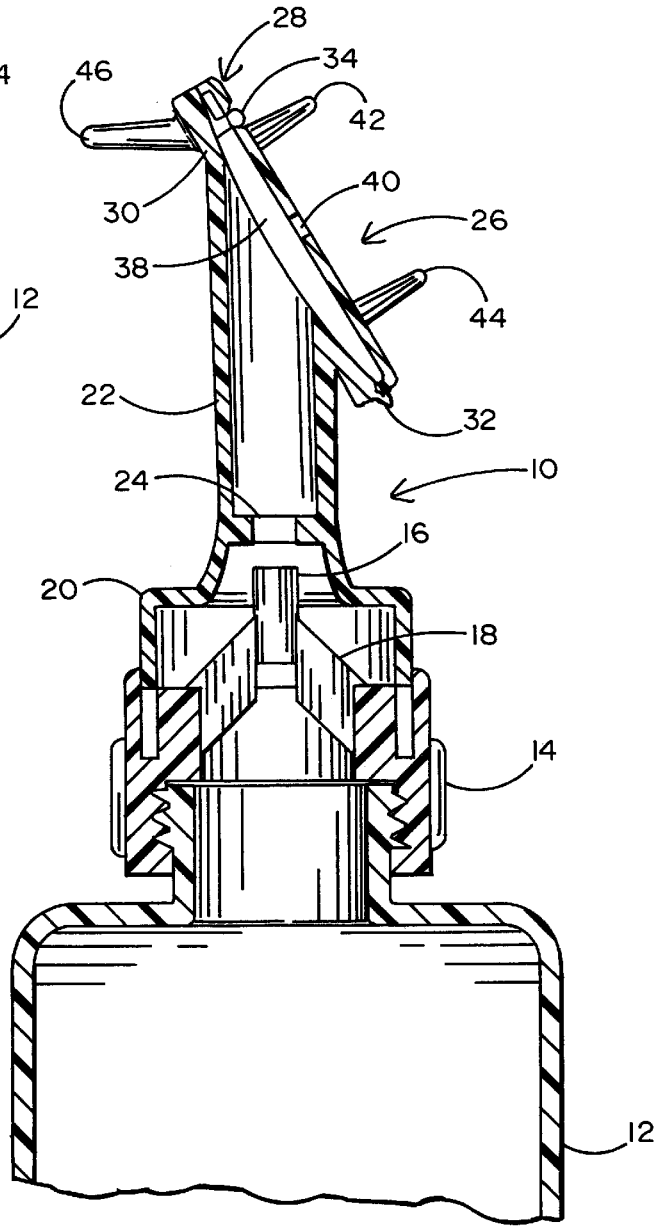
FIG. 2 is an enlarged axial section therethrough, with parts broken away.
Figure 7:
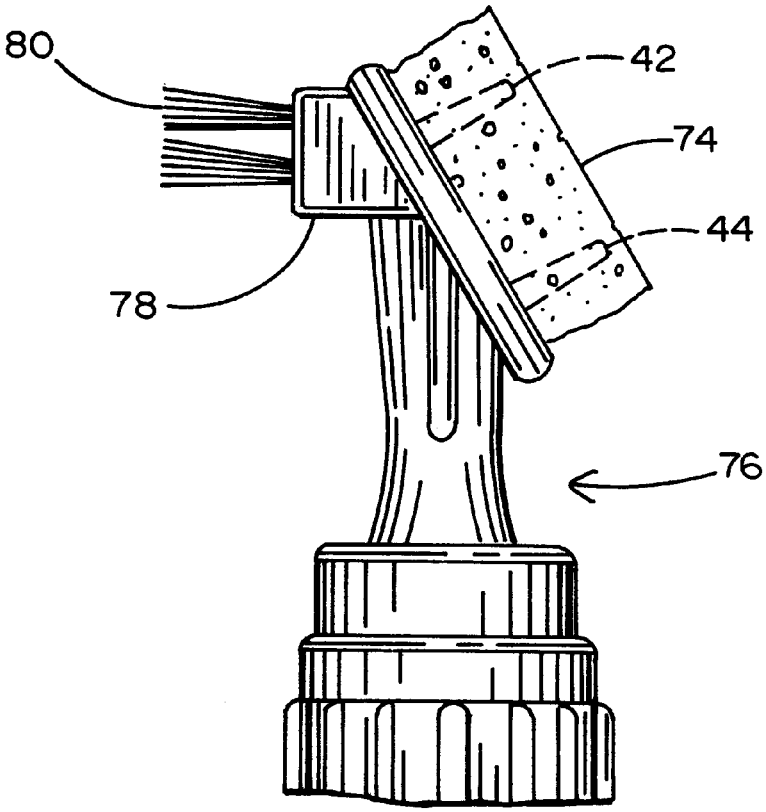
FIG. 7 is a side-elevational view of another embodiment of the dispenser heads, showing brush bristles instead of a comb and showing fingers with an optional sponge.

The dispensing head 76, shown in FIG. 7, is similar in its internal details to the dispenser head 10 shown in FIGS. 1, 2 and 6. It has fingers 42 and 44 which releasably hold an open cell synthetic polymer foam pad 74 in place. Instead of the comb fingers, the dispenser head 76 has a boss 78 into which are mounted brush bristles 80. Two rows of brush bristles are convenient, as indicated. The brush bristles extend the entire width of the dispenser head, similar to the width of the comb fingers 46 shown in FIG. 4. When health and beauty product fluid is dispensed through the head 76, it may be dispensed through the optional sponge 74. It is applied and distributed either by fingers 42 and 44 or optional foam pads 74. When it is applied, the head can be turned around and the brush bristles 80 can brush the fluid product onto the skin surface or into the hair, as desired.

This invention has been described in its presently preferred embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A fluid dispenser comprising:

a reservoir for fluid products, said reservoir having an outlet;

a fluid flow control valve connected to said outlet of said reservoir to control flow of fluid out of said reservoir, a feed tube connected to said valve;

a dispenser head connected to said feed tube to receive fluid from said valve, said dispenser head being comprised of a front panel and a back panel, said front panel and said back panel being secured together to form said dispenser head, said dispenser head having a pocket therein into which fluid is delivered from said valve, a dispenser face on said front panel, an elongated dispenser opening in said dispenser face to permit fluid to be discharged from said pocket in said dispenser head to said dispenser face;

a plurality of fingers mounted on said dispensing face adjacent said dispenser opening, a bristle brush mounted on said dispenser head, said bristle brush being positioned away from said dispensing face.

2. A fluid dispenser comprising:

a reservoir for fluid products, said reservoir having an outlet;

a fluid flow control valve connected to said outlet of said reservoir to control flow of fluid out of said reservoir, a feed tube connected to said valve;

a dispenser head connected to said feed tube to receive fluid from said valve, said dispenser head having a front panel and a back panel, said dispenser head having a dispenser face on said front panel, an opening in said dispenser face to permit fluid to be discharged from said dispenser head to said dispenser face, said dispenser head having a pocket therein into which fluid is delivered from said valve and said dispenser head opening is an elongated dispenser opening from said pocket;

a plurality of fingers on said dispenser face, said fingers being positioned adjacent said dispenser opening in said dispenser face so that fluid material discharged out of said dispenser opening can be distributed by said fingers, a plurality of comb teeth, said plurality of comb teeth being mounted on said back panel, said comb teeth being positioned so that they can be alternately employed in working fluid material into the hair of the user.

3. The fluid dispenser of claim 2 wherein said fingers are positioned in at least one row, said row being on one side of said elongated dispenser opening.

4. The fluid dispenser of claim 3 wherein said dispenser opening is a sinuous slot.

5. The fluid dispenser of claim 3 wherein there is a plurality of comb teeth mounted on said dispenser head, said plurality of comb teeth being positioned away from said dispensing face.

6. The fluid dispenser of claim 2 wherein said fluid opening is an elongated open and said fingers are arranged in at least one row, said row being on said face and being on one side of said dispenser opening.

7. The fluid dispenser of claim 6 further including a porous pad positioned on said dispensing face, said porous pad being for distributing fluid from said dispensing slot.

8. The fluid dispenser of claim 7 wherein said porous pad is an open cell synthetic polymer foam pad and said pad hydraulic system openings therein through which said fingers extend to both hold said foam pad in place and to distribute fluid being passed through said pad.

9. The fluid dispenser of claim 2 wherein said fingers are brush bristles.

10. A fluid dispenser for dispensing health and beauty products comprising:

a reservoir for containing a fluid product, said reservoir having an outlet;

a dispenser head formed of a front panel and a back panel, said front panel and said back panel being secured together, a fluid inlet in said back panel, said panels having a fluid pocket therebetween, said reservoir having its outlet connected to said fluid inlet of said back panel, said dispenser head having a face on said front panel, a fluid dispensing opening on said face of said dispenser head, said dispenser opening being an elongated slot so that said pocket feeds health and beauty fluid to said elongated slot, a plurality of fingers extending from said face of said dispenser head, said fingers being mounted on said front panel, said fingers being positioned on opposite sides of said fluid outlet so that said fingers can distribute fluid products.

11. The fluid dispenser of claim 10 further including a comb mounted on said dispenser head, said comb being comprised of a plurality of comb teeth arranged in a row so that when said fingers disperse fluid into the hair of the user, said comb can be used to further distribute the fluid in the hair.

12. The fluid dispenser of claim 10 wherein said slot is an elongated sinuous slot and said fingers are located in at least one row, said row of fingers being positioned on one side of said sinuous slot.

13. The fluid dispenser of claim 10 wherein said first and second panels are formed of thermoplastic synthetic polymer composition material and are hinged together to form said dispenser head.

14. The fluid dispenser of claim 10 further including a porous pad positioned on said dispensing face, said fingers being extended through said porous pad and extended therefrom so that said porous pad distributes fluid and said fingers further distribute the fluid.

15. The fluid dispenser of claim 14 further including a comb mounted on said dispenser head, said comb being comprised of a plurality of comb teeth arranged in a row so that when said fingers disperse fluid into the hair of the user, said comb can be used to further distribute the fluid in the hair.

16. A fluid dispenser for dispensing health and beauty products comprising:

a reservoir for containing a fluid product, said reservoir having an outlet;

a dispenser head, said dispenser head having a fluid inlet, said dispenser head having front and back panels, said front and back panels each having edges, a face on said front panel said front and back panels being sealed together at their joined edges to prevent leakage of product from the edges, said reservoir having its outlet connected to said fluid inlet of said dispenser head, said dispenser head having a face, a fluid outlet on said face of said dispenser head, said fluid outlet being connected to receive fluid products from said dispenser inlet, a plurality of fingers extending from said face of said dispenser head, said fingers being positioned on opposite sides of said fluid outlet so that said fingers can distribute fluid products, and a porous pad positioned on said dispensing face, said fingers being extended through said porous pad and extended therefrom so that said porous pad distributes fluid and said fingers further distribute the fluid.

* * * * *